US008317295B2

(12) United States Patent
Lai et al.

(10) Patent No.: US 8,317,295 B2
(45) Date of Patent: Nov. 27, 2012

(54) MICROPARTICLE/AEROSOL-COLLECTING DEVICE FOR OFFICE MACHINE

(75) Inventors: Yi-Lin Lai, Taipei (TW); Tien-Yu Pan, Taipei (TW); Tuo-Jen Chen, Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 404 days.

(21) Appl. No.: 12/153,386

(22) Filed: May 19, 2008

(65) Prior Publication Data

US 2009/0251507 A1 Oct. 8, 2009

(30) Foreign Application Priority Data

Apr. 3, 2008 (TW) ..... 97112423 A

(51) Int. Cl.
*B41J 2/165* (2006.01)

(52) U.S. Cl. ..... 347/34

(58) Field of Classification Search ..... None
See application file for complete search history.

(56) References Cited

U.S. PATENT DOCUMENTS 2,124,914 A * 7/1938 Fottinger ..... 415/89
6,254,348 B1 * 7/2001 Lee ..... 416/174
6,637,856 B2 10/2003 Nishi et al.
2006/0222426 A1 10/2006 Jen
2007/0109348 A1 * 5/2007 Izawa et al. ..... 347/34

FOREIGN PATENT DOCUMENTS

CN 1778559 A 5/2006
JP 2-113949 4/1990
JP 5-92576 4/1993
JP 2003-63021 3/2003

* cited by examiner

*Primary Examiner* — Matthew Luu
*Assistant Examiner* — Alejandro Valencia
(74) *Attorney, Agent, or Firm* — Jianq Chyun IP Office

(57) ABSTRACT

A microparticle/aerosol-collecting device for office machine. The microparticle/aerosol-collecting device is positioned near a printing section or a printer head. The microparticle/aerosol-collecting device includes a housing having an upper section and a lower section defining a space. The space has an opening. An absorption section is arranged in the space. The absorption section is formed with a chamber and multiple passages communicating with the chamber. The microparticle/aerosol-collecting device further includes a cleaning unit disposed in the chamber of the absorption section. The absorption section is rotationally drivable by a motor to create a negative pressure effect around the absorption section, whereby the airflow is collectively taken into the chamber of the absorption section through the passages thereof. Accordingly, the microparticles or ink aerosols are entrained by the airflow to go into the chamber. The microparticles or ink aerosols are then absorbed and removed by the cleaning unit.

8 Claims, 4 Drawing Sheets

MICROPARTICLE/AEROSOL-COLLECTING DEVICE FOR OFFICE MACHINE

BACKGROUND OF THE INVENTION

The present invention is related to a microparticle/aerosol-collecting device, and more particularly to a rotational microparticle/aerosol-collecting device mounted in an office machine for collecting ink aerosols suspended in the air.

A conventional printer includes a printing head positioned above a paper-feeding path by a set height. The printing head is reciprocally movable in a direction normal to the paper-feeding path, whereby the printing head is able to jet ink onto a paper and print the paper with figures or characters.

In general, the printing head includes multiple jet nozzles for jetting ink onto a paper. In the jetting operation, some ink drops often stagnate around the jet nozzles to eventually form solid sediments. The sediments will partially clog the jet nozzles to change the jet direction. This will affect the printing quality. Moreover, in printing operation, some ink aerosols are spread and suspended in the air. These ink aerosols will eventually fall onto unexpected portions of the printer, for example, the transmission members of the printer. In this case, the ink will be transfer printed onto the paper. In some cases, the ink aerosols will fall and collectively attach to the encoding sensor. This will affect the judgment of the jet carrier control system to cause misoperation of the printer.

Various types of cleaning devices have been developed for solving the problem of stagnation of ink drops around the jet nozzles. For example, Japanese Patent Nos. JP2003-63021, JP2-113949 and JP5-92576 respectively disclose rotational brush and wiper mechanisms. The brush and wiper mechanisms serve to pass through a lower side of the jet nozzles and once or twice back and forth wipe up the jet nozzles from the ink drops.

U.S. Pat. No. 6,637,856 B2 discloses a cleaning device including a rotatable cleaning roller arranged at lower end of the jet nozzle for wiping off ink drops or solid ink from the periphery of the jet nozzle. Chinese Patent No. 1778559A discloses a jet printer equipped with a cleaning unit. The cleaning unit includes a collecting container positioned under the jet nozzle for sealing the jet nozzle. The container is drivable by a transmission mechanism to reciprocally move under the jet nozzle. The container is connected to a sucking unit via a conduit, whereby the sucking unit is able to suck off the ink drops from the periphery of the jet nozzle.

Some other cleaning devices employ static generators for absorbing powders and dusts from a paper delivered within a paper-feeding path of an office machine. For example, Taiwanese Patent No. 94109929 (U.S. Patent No. 2006/0222426 A1) discloses a typical device employing a rotary member and silk material for generating static by means of friction to absorb powders and dusts from a paper passing through a paper-feeding path. However, such dust-collecting device still has some shortcomings. For example, the device can only absorb powders and dusts from one face of the paper, while failing to absorb the powders and dusts attaching to the other face of the paper. Furthermore, all the above devices cannot collect or clean off the ink aerosols or microparticles suspended in the air.

It is therefore tried by the applicant to provide a microparticle/aerosol-collecting device mountable in an office machine and capable of effectively collecting and cleaning off microparticles or ink aerosols suspended in the air.

SUMMARY OF THE INVENTION

It is therefore a primary object of the present invention to provide a microparticle/aerosol-collecting device for office machine. The microparticle/aerosol-collecting device is positioned near a printing section or a printing head. The microparticle/aerosol-collecting device includes a housing having an internal space and an opening and includes an absorption section arranged in the space. The absorption section has multiple passages and is rotationally drivable by a motor. When driven by the motor, the absorption section creates a negative pressure effect to suck air into the absorption section, whereby the microparticles or ink aerosols suspended in the air are entrained by the air to go through the passage into the absorption section. A cleaning unit is arranged in the absorption section. After the microparticles or ink aerosols go into the absorption section, the microparticles or ink aerosols are absorbed and removed by the cleaning unit without attaching to any portion of the office machine. Therefore, the printing quality can be ensured and misoperation of the office machine can be avoided.

It is a further object of the present invention to provide the above microparticle/aerosol-collecting device in which the absorption section is a cylindrical body having a shaft. The shaft is formed with a chamber. The passages of the absorption section are radially arranged to communicate with the chamber.

It is still a further object of the present invention to provide the above microparticle/aerosol-collecting device in which the cleaning unit is arranged in the chamber. When the absorption section rotates, the microparticles or ink aerosols entering the absorption section are absorbed and removed by the cleaning unit.

It is still a further object of the present invention to provide the above microparticle/aerosol-collecting device in which according to a cross-section of the absorption section, the passages are radially arranged in a turbination-like pattern.

It is still a further object of the present invention to provide the above microparticle/aerosol-collecting device in which each passage has an inlet and an outlet. The inlet of the passage has a width larger than a width of the outlet of the passage.

The present invention can be best understood through the following description and accompanying drawings wherein:

BRIEF DESCRIPTION OF THE DRAWINGS

FIG. 1-1 is a side view according to FIG. 1, showing a modification of the embodiment of FIG. 1, in which the width of the inlet of the passage of the absorption section is larger than the width of the outlet of the passage;

FIG. 3-1 is a side view according to FIG. 3, showing a modification of the embodiment of FIG. 3, in which the width of the inlet of the passage of the absorption section is larger than the width of the outlet of the passage.

DETAILED DESCRIPTION OF THE PREFERRED EMBODIMENTS

Figure 1:
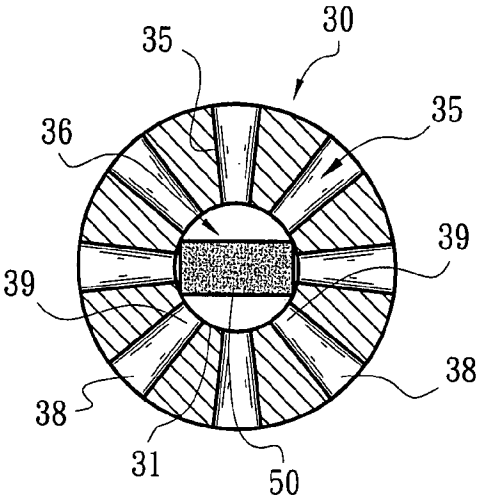
FIG. 1 is a side view of a preferred embodiment of the microparticle/aerosol-collecting device for office machine of the present invention.
Figure 1:
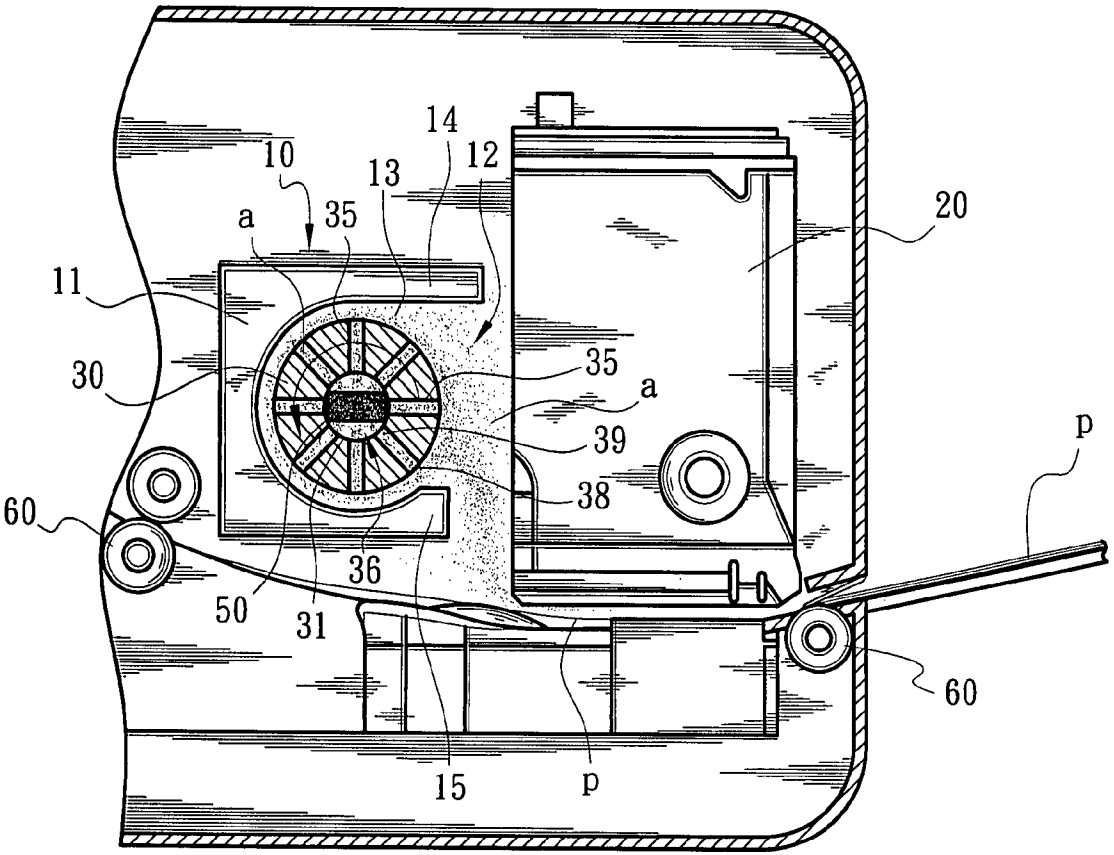
Figure 2:
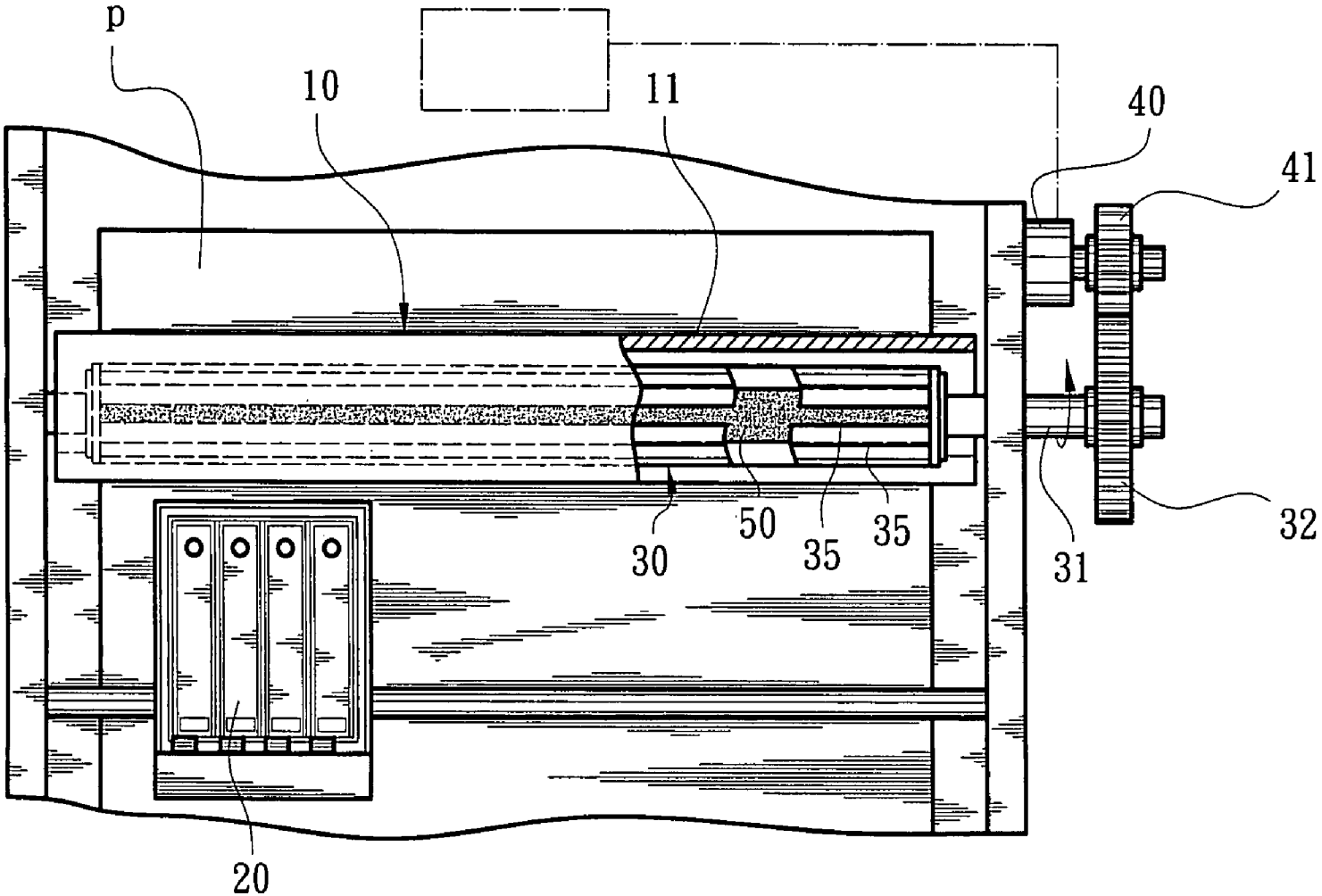
FIG. 2 is a front according to FIG. 1.

Please refer to FIGS. 1 and 2. The microparticle/aerosol-collecting device 10 for office machine of the present invention is positioned near a printing section or a printing head 20. The device 10 includes a housing 11 having an upper section 14 and a lower section 15 defining a space 13. The space 13 has an opening 12. An absorption section 30 is arranged in the space 13 for absorbing or collecting microparticles or ink aerosols a suspended in the air.

Referring to FIG. 2, the absorption section 30 is rotationally drivable by a motor 40 to create a negative pressure effect around the absorption section 30. Accordingly, the air is taken into the absorption section 30, whereby the microparticles or ink aerosols a suspended in the air are entrained by the air to go into the absorption section 30. In this embodiment, the absorption section 30 is a cylindrical body having a shaft 31 and a gear 32 mounted on the shaft 31. The gear 32 is engaged with a gear 41 of the motor 40, whereby the motor 40 can drive the absorption section 30 to rotate.

Referring to FIGS. 1 and 1-1, the shaft 31 of the absorption section 30 is hollow and formed with a chamber 36. In this embodiment, the absorption section 30 is formed with multiple radial passages 35 each having an inlet 38 and an outlet 39. The passages 35 communicate with the chamber 36 of the shaft 31. According to a cross-section of the absorption section 30, the passages 35 are radially arranged. In addition, the length and position of the passages 35 are changeable. In a preferred embodiment, the width of the inlet 38 is larger than the width of the outlet 39 as shown in FIG. 1-1.

A cleaning unit 50 is positioned in the chamber 36 of the shaft 31. The cleaning unit 50 is made of a spongy material or the like. When the absorption section 30 rotates, the microparticles or ink aerosols a entering the absorption section 30 are absorbed by the cleaning unit 50. The absorption section 30 and the cleaning unit 50 are replaceable.

When a paper p is fed by rollers 60 to pass through a printing section or printing head 20 for printing operation, the absorption section 30 is rotated by the motor 40 to create a negative pressure effect around the absorption section 30. Accordingly, the air is taken into the chamber 36 through the passages 35 of the absorption section 30. At this time, the microparticles or ink aerosols a generated in the printing operation are entrained by the airflow to go into the chamber 36. The microparticles or ink aerosols a are then absorbed and removed by the cleaning unit 50. Therefore, the microparticles or ink aerosols a are hindered from falling onto unexpected portions of the printer as shown in FIG. 1. It should be noted that the air going into the absorption section 30 is exhaustible from the chamber 36.

As shown in FIG. 1, the upper section 14 of the housing 11 has a length longer than that of the lower section 15, whereby the microparticles or ink aerosols a moved toward the absorption section 30 can be detained as nearby as possible.

Figures 1, 3:
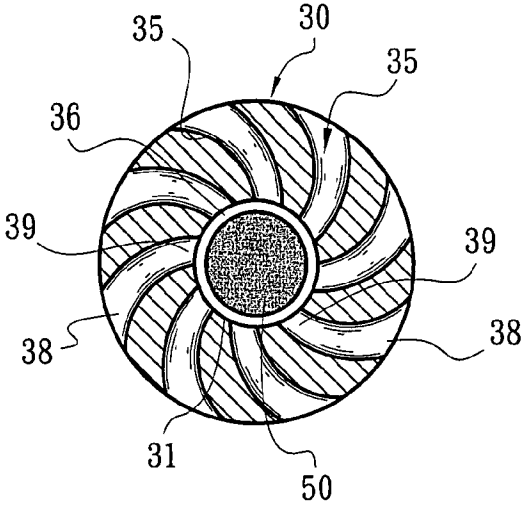
FIG. 3 is a side view of another preferred embodiment of the microparticle/aerosol-collecting device for office machine of the present invention.
Figure 3:
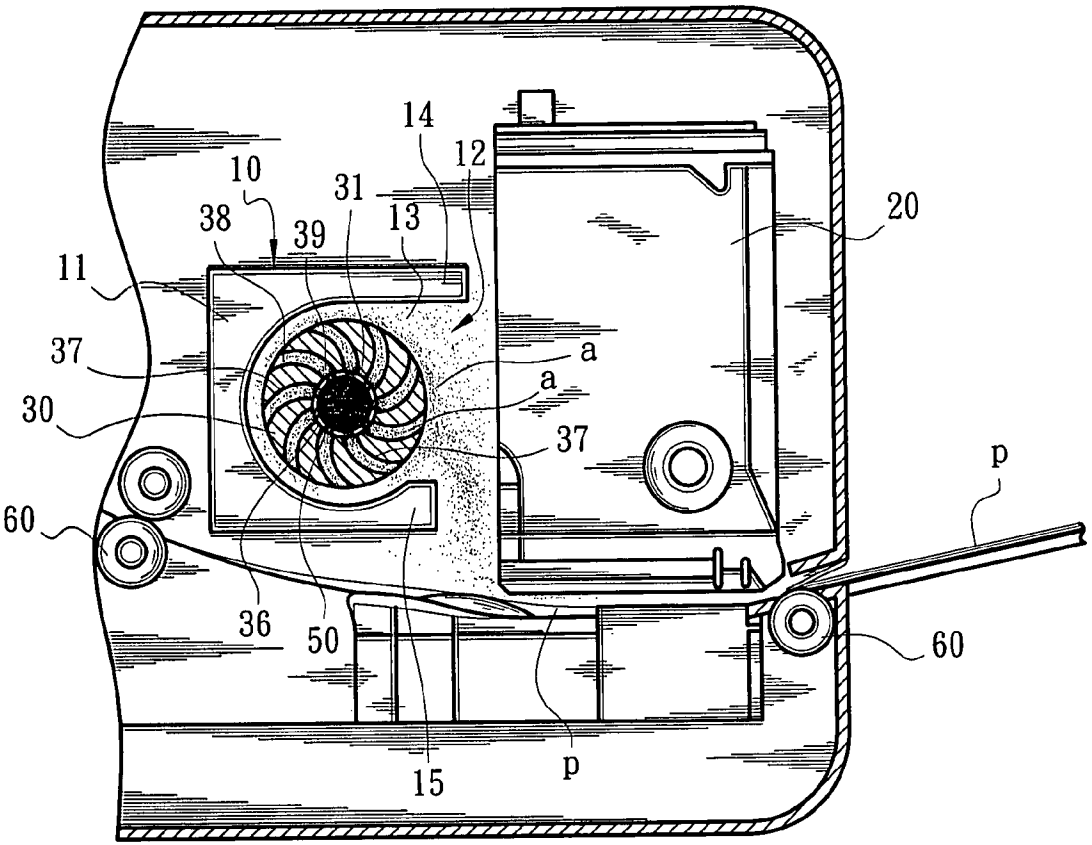

FIG. 3 shows a second embodiment of the microparticle/aerosol-collecting device 10 for office machine of the present invention. The absorption section 30 is formed with multiple radial curved passages 37 each having an inlet 38 and an outlet 39. The passages 37 communicate with the chamber 36 of the shaft 31. According to a cross-section of the absorption section 30, the passages 35 are radially arranged in a turbination-like pattern. The cleaning unit 50 is positioned in the chamber 36 of the shaft 31. When a paper p is fed by rollers 60 to pass through a printing section or printing head 20 for printing operation, the absorption section 30 is rotated by the motor 40 to suck in the microparticles or ink aerosols a generated in the printing operation. The microparticles or ink aerosols a go through the passages 37 into the chamber 36 and then are absorbed by the cleaning unit 50.

The curvature of the passages 37 is changeable. For example, the curvature of the passage 37 can be such increased that the passage 37 is curved from a direction approximately tangential to the absorption section 30 toward a direction normal to the chamber 36. In a preferred embodiment, the width of the inlet 38 of the passage 37 is larger than the width of the outlet 39 as shown in FIG. 3-1.

Figure 4:
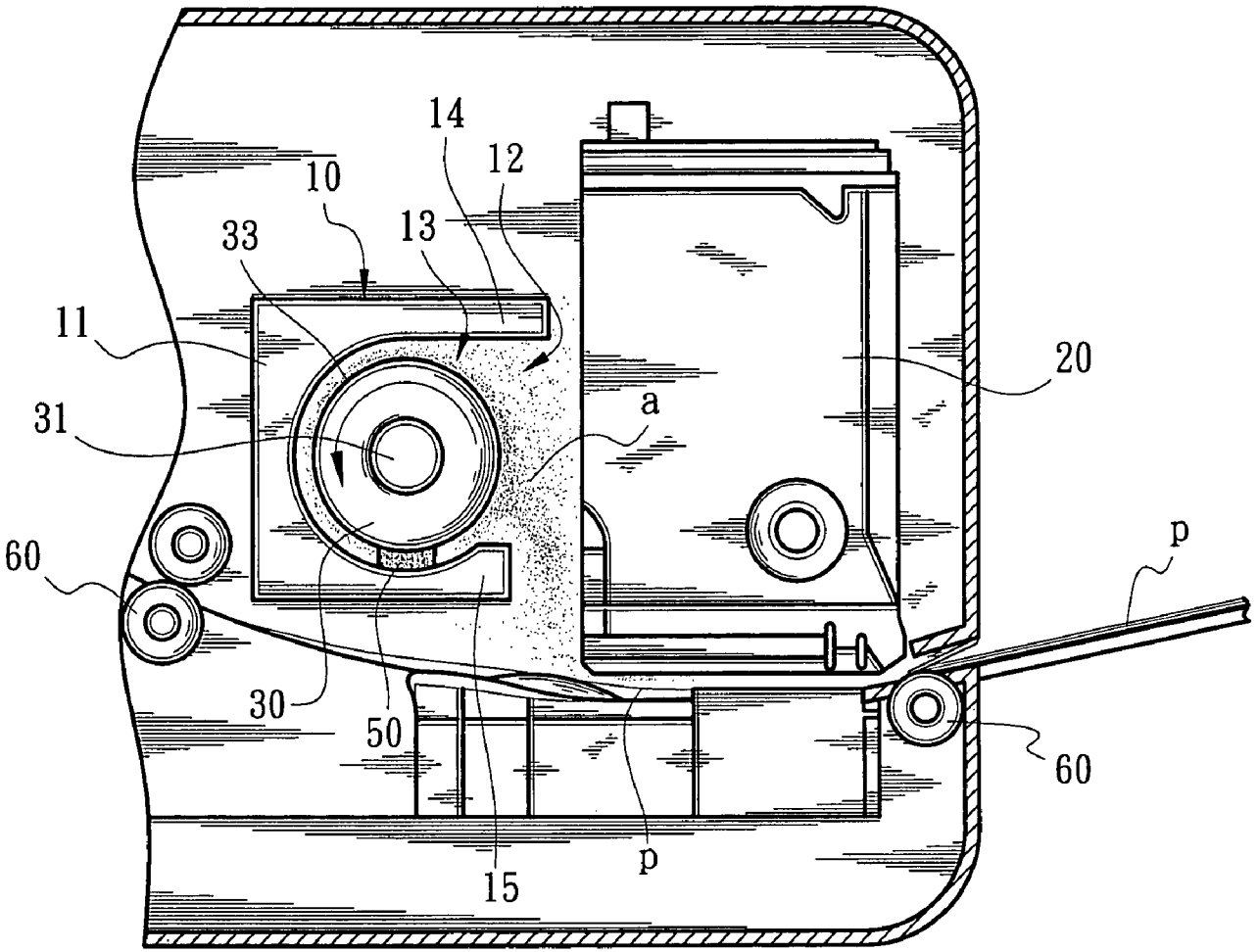
FIG. 4 is a side view of still another preferred embodiment of the microparticle/aerosol-collecting device for office machine of the present invention.

FIG. 4 shows a third embodiment of the microparticle/aerosol-collecting device 10 for office machine of the present invention, in which the absorption section 30 is positioned in the housing 11 to carry static for absorbing or collecting microparticles or ink aerosols a suspended in the air. The absorption section 30 has a form of a roller. The absorption section 30 is preferably made of plastic, rubber or chemical fiber material. The absorption section 30 is rotationally drivable by the motor 40 to abrade air and create static.

As shown in FIG. 4, a cleaning unit 50 is arranged in the space 13 between the housing 11 and the absorption section 30 in contact with a surface 33 thereof. When the absorption section 30 rotates, the cleaning unit 50 wipes off the microparticles or ink aerosols a from the surface 33 of the absorption section 30.

When a paper p is fed by rollers 60 to pass through a printing section or printing head 20 for printing operation, the microparticles or ink aerosols a generated in the printing operation are attracted by the absorption section 30 carrying static. The microparticles or ink aerosols a will attach to the surface 33 of the absorption section 30 without falling onto unexpected portions of the printer as shown in FIG. 4.

In printing operation of the printing section or printing head 20, the shaft 31 and the absorption section 30 are rotationally driven by the motor 40. At this time, the surface of the absorption section 30 will attract the microparticles or ink aerosols a generated in the printing operation. Simultaneously, the cleaning unit 50 will wipe off the microparticles or ink aerosols a from the surface 33 of the absorption section 30.

In a preferred embodiment, the surface 33 of the absorption section 30 is roughed or formed with numerous fine brush hairs for enhancing the microparticle/aerosol-collecting effect.

According to the above arrangements, the microparticle/aerosol-collecting device of the present invention is able to effectively absorb and clean off the microparticles and ink aerosols suspended in the air inside the office machine. This ensures printing quality of the office machine and minimizes the possibility of misoperation of the office machine.

The above embodiments are only used to illustrate the present invention, not intended to limit the scope thereof. Many modifications of the above embodiments can be made without departing from the spirit of the present invention.

What is claimed is:

1. A microparticle/aerosol-collecting device for an office machine, the microparticle/aerosol-collecting device being positioned near a printing section or a printing head, the microparticle/aerosol-collecting device comprising:

an absorption section having at least one passage formed therein, the passage having an inlet and an outlet, wherein the absorption section is a cylindrical body having a shaft and a gear mounted on the shaft, the shaft of the absorption section is hollow and formed with a chamber, and a cleaning unit is arranged in the chamber of the shaft; and a motor for rotationally driving the absorption section, when the absorption section is rotationally driven by the motor, the absorption section creating a negative pressure effect to suck air into the absorption section, whereby the microparticles or ink aerosols suspended in the air are entrained by the air to go through the passage into the absorption section, and the gear of the absorption section is engaged with a gear of the motor.

2. The microparticle/aerosol-collecting device for office machine as claimed in claim 1, further comprising a housing having an upper section and a lower section defining a space, the space having an opening, the absorption section being arranged in the space.

3. The microparticle/aerosol-collecting device for office machine as claimed in claim 2, wherein the upper section of the housing has a length longer than that of the lower section of the housing.

4. The microparticle/aerosol-collecting device for office machine as claimed in claim 1, wherein the absorption section is formed with multiple passages each having an inlet and an outlet, the passages communicating with the chamber of the shaft, according to a cross-section of the absorption section, the passages being radially arranged.

5. The microparticle/aerosol-collecting device for office machine as claimed in claim 1, wherein the cleaning unit is made of a spongy material or the like.

6. The microparticle/aerosol-collecting device for office machine as claimed in claim 1, wherein according to a cross-section of the absorption section, the passages are radially arranged in a turbination-like pattern.

7. The microparticle/aerosol-collecting device for office machine as claimed in claim 1, wherein, the inlet of the passage has a width larger than a width of the outlet of the passage.

8. The microparticle/aerosol-collecting device for office machine as claimed in claim 1, wherein the absorption section carries static.

* * * * *